US006832396B1

(12) United States Patent
Lin

(10) Patent No.: US 6,832,396 B1
(45) Date of Patent: Dec. 21, 2004

(54) BACK-TO-BACK BATHROOM TAP CONTROL VALVE

(75) Inventor: Shih-Hung Lin, Taichung Export Processing Zone (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 0 days.

(21) Appl. No.: 10/631,780

(22) Filed: Aug. 1, 2003

(51) Int. Cl.[7] ..... E03C 1/04
(52) U.S. Cl. ..... 4/675; 4/676; 4/677; 137/270
(58) Field of Search ..... 4/675, 676, 677; 137/269, 270

(56) References Cited

U.S. PATENT DOCUMENTS

| | | | | |
|---|---|---|---|---|
| 6,123,105 | A * | 9/2000 | Yang | 137/270 X |
| 6,640,357 | B1 * | 11/2003 | Chang | 4/675 |
| 6,718,569 | B2 * | 4/2004 | Burger et al. | 4/695 |
| 2004/0140004 | A1 * | 7/2004 | Ouyoung | 4/675 X |

OTHER PUBLICATIONS

US 2004/0140004 A1, Jul. 2004, Ouyoung, 4/675 X.*

* cited by examiner

*Primary Examiner*—Gregory L. Huson
*Assistant Examiner*—Kathleen J. Prunner
(74) *Attorney, Agent, or Firm*—Leong C. Lei

(57) ABSTRACT

An improved bathroom tap water control valve allowing back-to-back installation includes a body, a water guide and a water temperature control unit, an adaptation trough at the center of the body, the guide being hollow having a disk adapter at bottom to be received in the adaptation trough; the water temperature control unit comprised of a casing and a spindle being accommodated inside the guide; a primary and a secondary supply lines being respectively provided on both sides of the body; a primary and a secondary supply pipes connecting through the primary and the secondary supply lines being provided to the guide; an upper supply area connecting through the primary supply pipe and a lower supply are connecting through the secondary supply pipe being respectively provided on the casing of the water temperature control unit; characterized by that the guide being capable of exercising 180-degree rotation to allow interchangeable conduction between the primary and the secondary supply pipes and the primary and the secondary supply lines.

1 Claim, 5 Drawing Sheets

BACK-TO-BACK BATHROOM TAP CONTROL VALVE

BACKGROUND OF THE INVENTION (a) Technical Field of the Invention

The present invention is related to an improved structure of a bathroom tap, and more particularly to one that is provided with a cased mechanism of tap control valve for the regulation of cold and hot water allows back-to-back installation in a single wall without altering the existing cold and hot water pipeline.

(b) Description of the Prior Art

The configuration of a cased tape as referred in the present invention is basically as illustrated in FIG. 4 with the installation method as illustrated in FIG. 1 of the accompanying drawings. Wherein, a water control valve 1 is encased into a wall with a cold water supply line and a hot water supply line of the water control valve 1 respectively connected to a cold water pipe 3 and a hot water pipe 2 buried in the wall so to allow both of the cold and hot water enter into a water temperature control unit 30, wherein, a spindle exposed out of the water temperature control unit 30 is used in the assembly of a knob mechanism to execute control and regulation of the delivery of both of the cold and hot water. A delivery switch 16 is provided to control the on and off of the delivery and the amount of the delivery, and the hot and the cold water so mixed is then delivered through a primary delivery pipe 14 to the tap or through a secondary delivery pipe 15 to a shower head (the description of such delivery being related to a prior art, thus not repeated here). However, though the water control valve works fine when it is installed only on one side of a wall, problems of use or installation emerge when the installation of the water control valve on both sides of the wall is required. The design of supply locations respectively for the cold and the hot water of the water control valve are fixed while the configuration of the cold and hot water pipes inside the wall are also fixed. Therefore, on the condition that the existing pipeline is not altered during the installation of the water control valve on each side of a wall, a T-joint is forthwith used to separately connect the cold water pipe and two supply lines respectively from one end while another T-joint is used to separately connect the hot water pipe and two supply lines respectively from another end. The two water control valves as illustrated in FIG. 2. In such a layout, the knob mechanism, when turned to its left, delivers the cold water and when turned to its right, the hot water is delivered as is normally the case. However, on the other side of the wall, it becomes abnormal when the knob mechanism is turned to its left, the cold water is delivered, or to its right, the hot water is delivered. The user may have a good chance to get burnt by a sudden gush of hot water. To avoid this, an additional pipe may be connected to each supply line to either water control valve that further crosses to be connected to those pipe lines for the other water control valve to make sure that the way to regulate water temperature is identical on both sides of the wall. However, as the wall area is limited, the work of having the additional pipe is not ideal as the work hours and installation are concerned.

SUMMARY OF THE INVENTION

The primary purpose of the present invention is to provide to provide a water control valve given with an extremely delicate change so to easily achieve the purpose of having the water temperature regulation to be done in the same direction by a mild adjustment. To achieve the purpose, the structure of the present invention is basically identical to that of the prior art by having a body of a control valve and a water temperature control unit provided between two supply lines and two delivery tubes. The present invention is characterized by that a part on the body of the valve used to accommodate the water temperature control unit is designed into an independent guide, while at the center of the body of the valve an adaptation trough is provided to receive the guide and make it adjustable by rotation. Furthermore, the guide is adapted to the water temperature control unit. While two control valves are mounted back-to-back in the same wall, it only takes to turn either one for 180 degrees to change the location of the water temperature control unit for the cold and the hot water. Therefore, the same rotation direction is achieved for both water valves mounted back-to-back with its spindle turned to regulate the delivery of the cold and the hot water. Accordingly, the present invention while solving the problems of extended work hours and complicated installation as observed with the prior art makes sure that the back-to-back installation of two control valves in the same wall is done in the easiest way to achieve the safe and convenient use.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
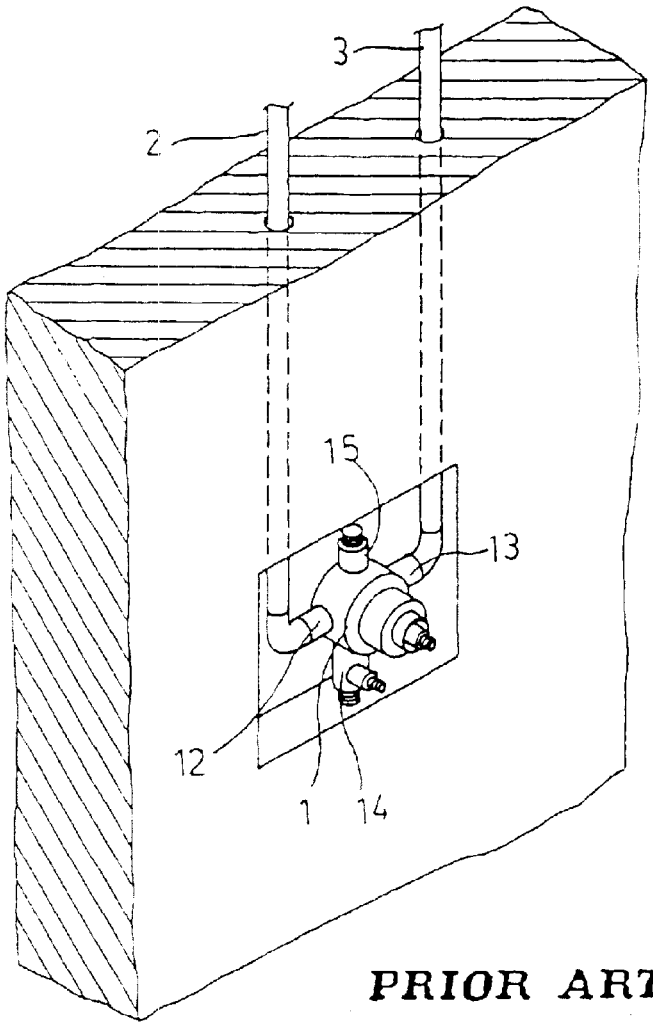
PRIOR ART FIG. 1
FIG. 1 is a schematic view showing an installation layout of a water control valve.
Figure 2:
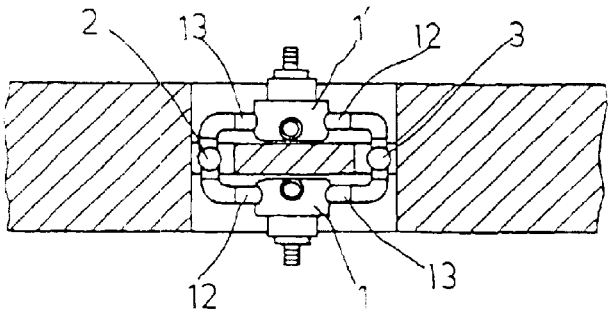
PRIOR ART FIG. 2
FIG. 2 is a schematic view showing a back-to-back installation layout of two water control valves.
Figure 3:
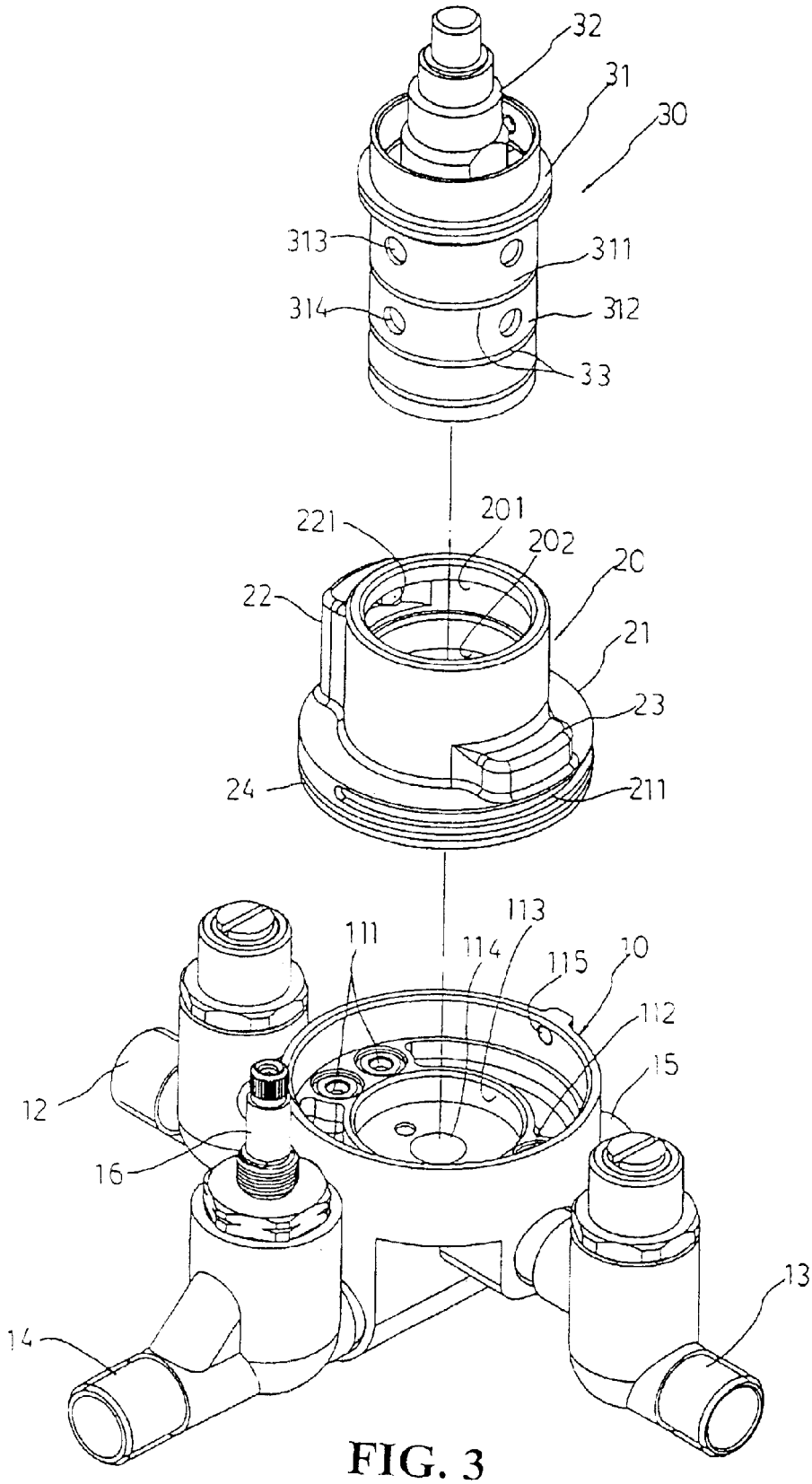
FIG. 3 is an exploded view of a preferred embodiment of a water control valve of the present invention.

Referring to FIGS. 1 and 2, a preferred embodiment of the present invention relates to an improved structure of a bathroom tap water control valve that allows back-to-back installation in a single wall. The primary purpose of the improvement is to make both water control valves 1 being able to respectively and directly connect to the hot and cold water supply lines 2, 3 so to allow both knobs of the water valves to be turned in the same direction either for the delivery of hot water or cold water.

As illustrated in FIGS. 3 through 6, the water control valve 1 of a preferred embodiment of the present invention is essentially comprised of a body 10, a guide 20, and a water temperature control unit 30. Wherein, an adaptation trough 11 is provided at the center of the body and a primary supply line 12, a secondary supply line 13, a primary delivery tube 14 and a secondary delivery tube 15 are respectively provided on the circumference of the body 10 in a cross pattern with the primary and the secondary supply lines 12, 13 directly facing each other, and the primary and the secondary delivery tubes 14, 15 directly facing each other. A primary water inlet 111 connecting through the primary supply line 12 and a secondary water inlet 112 connecting through the secondary supply line 13 are respectively provided on the both sides on the surface of the adaptation trough 11. An insertion trough 113 is provided a in recess at the center of the adaptation trough 11 and a water outlet 114 connecting through the primary and the secondary delivery tubes 14, 15 is provided in the adaptation trough 11, while a locking screw hole 115 is separately provided on one side of the wall of the adaptation trough 11. The guide 20 related to a hollow cylinder having on its inner wall provided with an upper guide channel 201 in circle and a lower guide channel 202 also in circle with a disk shaped adaptation part 21 in the same diameter of that of the adaptation trough 11 being provided on the base of the guide 20. A locking semi-circular groove 211 being provided on the circumference of the adaptation part 21 and a leak proof ring 24 is inserted on to where below the adaptation part 21. A higher protrusion 22 and a lower protrusion 23 are respectively provided on the top of the adaptation part 21 with both protrusions 22, 23 flushed with the surface of the guide 20. A primary guide pipeline 221 is provided inside the higher protrusion 22, with the inlet of the primary guide pipeline 221 disposed at the bottom of the adaptation part 21 and the outlet in the upper guide channel 201 of the guide 20. A secondary guide pipeline 231 is provided inside the lower protrusion 23 with the inlet of the secondary guide pipeline 231 disposed at the bottom of the adaptation part 21 and the outlet in the lower guide channel 202 of the guide 20. The water temperature control unit 30 related to that of the prior art is comprised of a cylindrical casing 31 containing a spindle 32 for regulating the mixing ratio of the cold and the hot water. A leak-proof ring 33 is used on the surface of the casing 31 to segregate the water temperature control unit 30 into an upper supply area 311 and a lower supply area 312. Multiple water inlets 313, 314 are respectively provided in the upper and the lower supply areas 311, 312.

Figure 4:
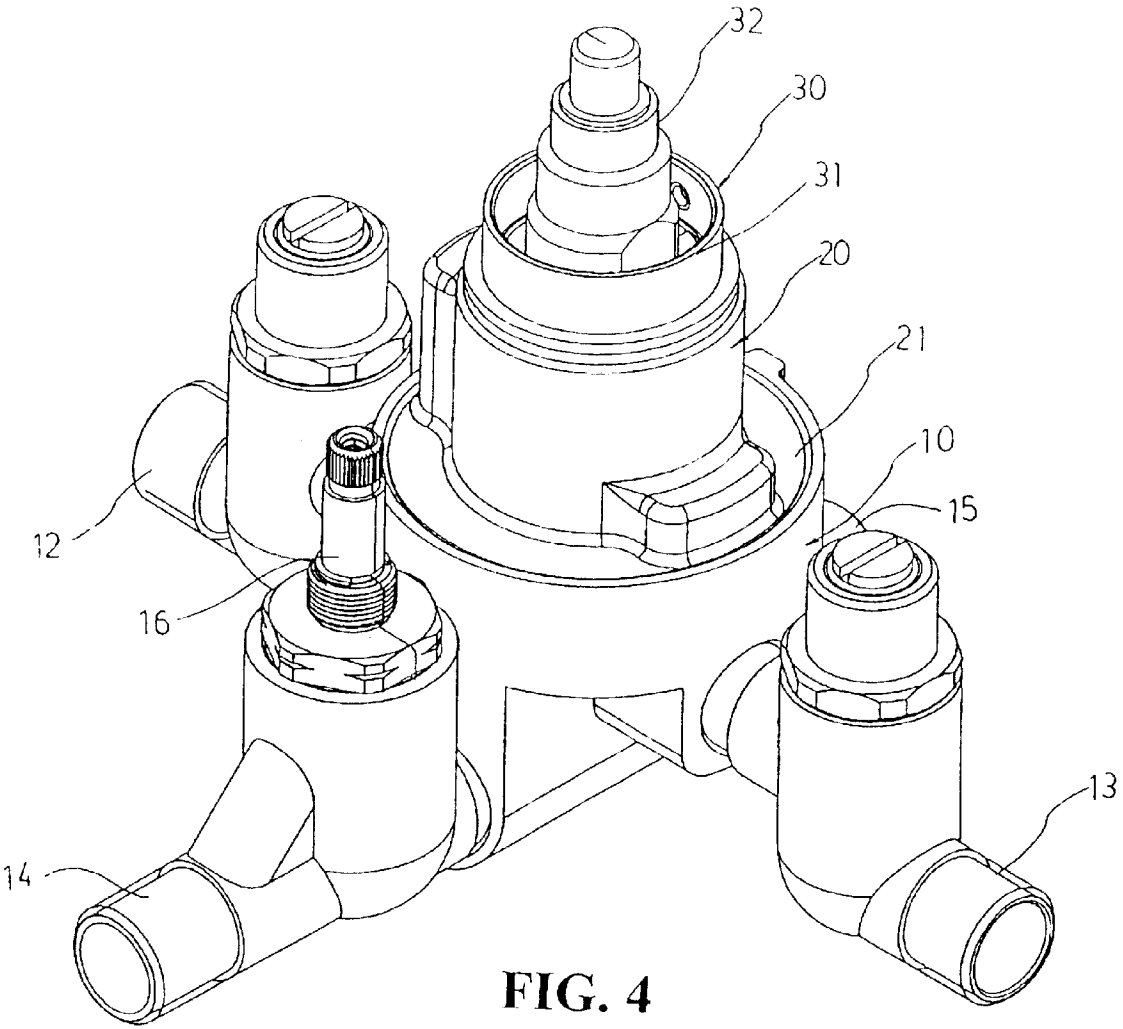
FIG. 4 is a schematic view showing the appearance of the preferred embodiment as assembled.
Figure 5:
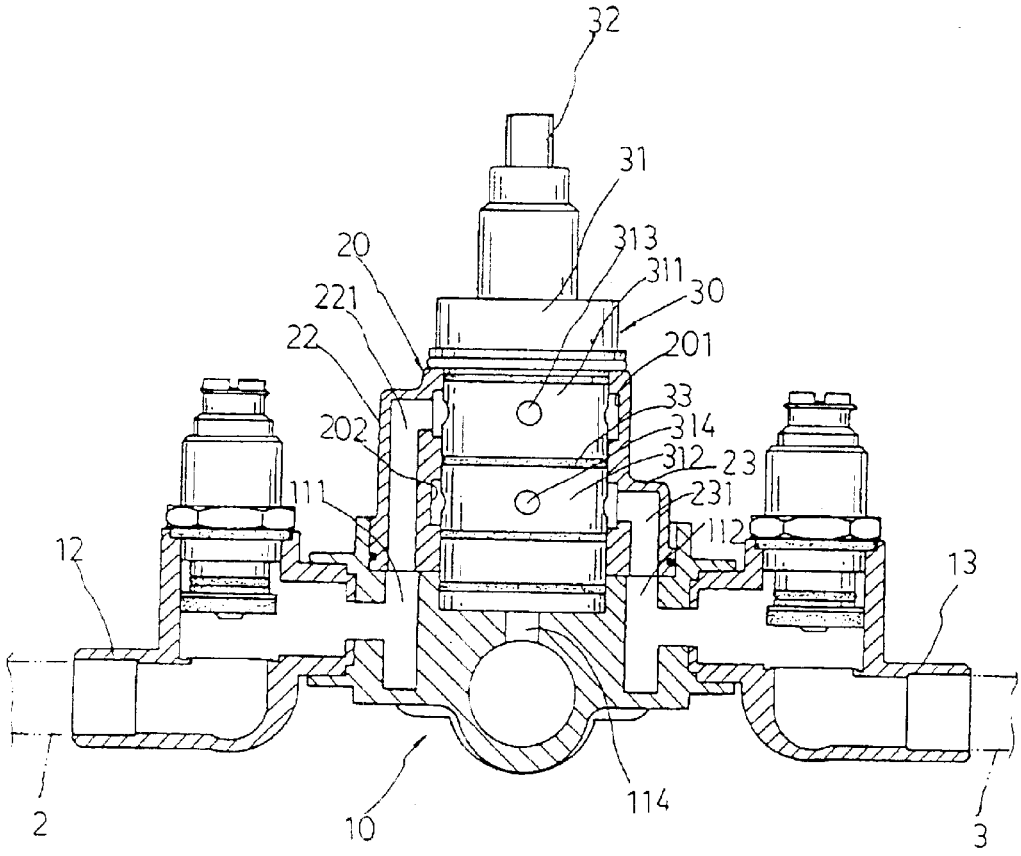
FIGS. 5 and 6 are sectional views of the preferred embodiment in practice.
Figure 6:
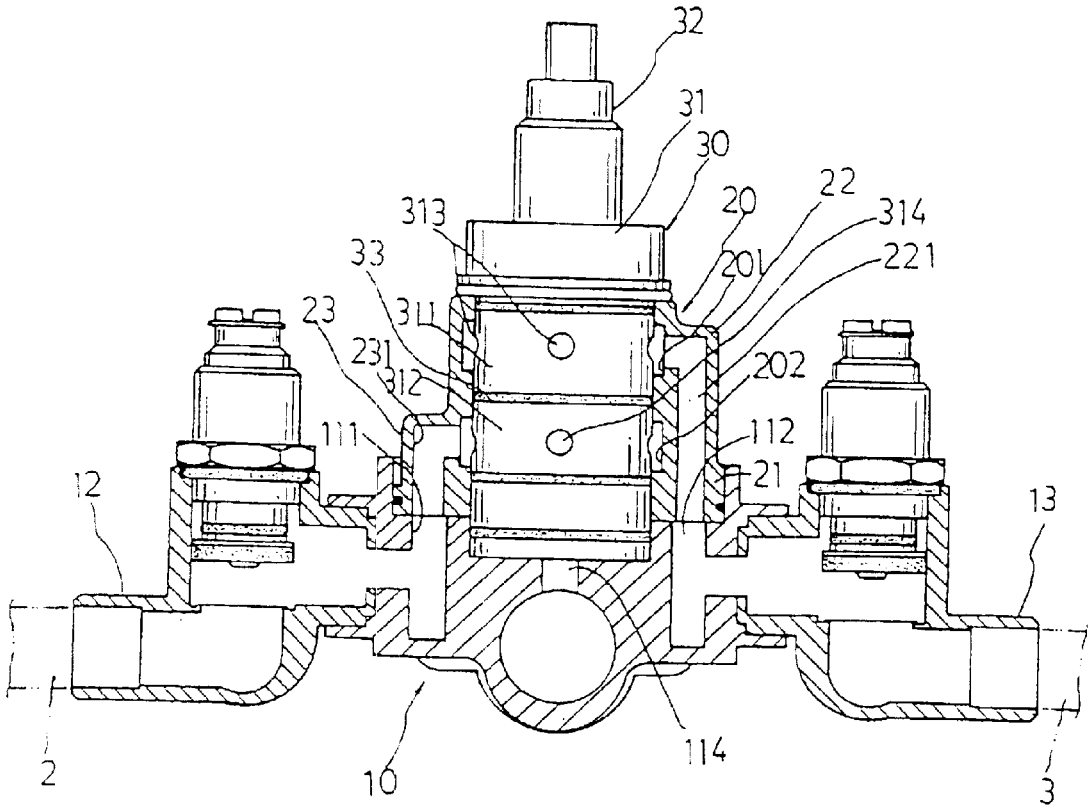

Now referring to FIGS. 4, 5, and 6, the adaptation part 21 of the guide 20 is placed into the adaptation trough 11 of the body 10 and is locked and packed into the locking groove 211 in the adaptation part 21 of the guide 20 with a bolt inserted through the locking screw hole 115, thus to incorporate the guide 20 to the body 10 while the primary inlet 111 in the adaptation trough 11 is connected through the primary guide pipeline 221 of the guide 20, and the secondary inlet 112, through the secondary guide pipeline 231. The water temperature control unit 30 is then immediately placed into the guide 20 with the bottom of the unit 30 inserted into the insertion trough 113 for the upper supply area 311 of the casing 31 to rest on the upper guide channel 201 on the inner wall of the guide 20 and the lower supply area 312, on the lower guide channel 202. The outlet (not illustrated) at the bottom of the water temperature control unit 30 is connected through the outlet 114 in the insertion trough 113.

As illustrated in FIGS. 2 and 5, when both water control valves 1 and 1' are mounted back-to-back in the same wall, the configuration of the installation of the front water control valve 1 is as illustrated in FIG. 5. Wherein, a hot water pipe 2 is connected to the primary supply line 12 of the body of the front water control valve 1 while a cold water pipe 3 is connected to the secondary supply line 13. The water pipeline at this moment has the hot water to flow from the primary supply line 12, through the primary inlet 111, and the primary guide pipeline 221 in the higher protrusion 22 of the guide 20 into the upper guide channel 201, and further into the spindle 32 through the water inlet 313 in the upper supply area 31 on the casing of the water temperature control unit 30. Meanwhile, the cold water flows from the secondary supply line 13 through the secondary water inlet 112 and the secondary guide pipeline 231 in the lower protrusion 23, and further into the spindle 32 through the water inlet 314 in the lower supply area 312. When the spindle 32 for the regulating of the mixing ratio of incoming cold and hot water is turned to its left, the temperature of the water delivered gets higher, and to its right, lower. That is, when the spindle is turned counterclockwise, the amount of the hot water flowing through the water inlet 313 in the upper supply area into the spindle is greater than the cold water flowing into the spindle from the inlet 314 in the lower supply area; on the contrary, when the spindle is turned clockwise, more cold water flows into the spindle.

As illustrated in FIGS. 2 and 6, the primary supply line 12 for another water control valve 1' on the back of the wall is connected to the cold water pipe 3 and the secondary supply line 13 is connected to the hot water pipe 2 in reverse order with that found with the front water control valve 1. Accordingly, the cold water enters from the primary water inlet 12 through the primary guide pipeline 221 into the upper guide channel 201, while the hot water enters from the secondary water inlet 13 through the secondary guide pipeline 231 into the lower guide channel 202. Relatively, the direction to turn the spindle 32 in regulating the mixing ratio of the hot and the cold water has to be the other way around. Therefore, the bolt in the locking screw hole 115 of the body 10 must be first loosened up to turn the guide 20 for 180 degrees until the bolt is restricted by another end of the locking groove 211, thus to allow the primary guide pipeline 221 of the guide 20 and the secondary supply line 13 are connected through each other for the hot water also flows into the upper guide channel 201, through the water inlet 313 in the upper supply area 311 and further into the spindle 32. Meanwhile, the secondary guide pipeline 231 is connected through the primary supply line 12 to admit the cold water flowing into the lower guide channel 202 through the water inlet 314 in the lower supply area 312 and further into the spindle. Accordingly, the locations respectively admitting the cold water and the hot water into the spindle 32 for the water control valve 1' mounted on the back of the wall is identical with that mounted on the front of the wall. In turn, the direction to turn the spindle 32 for the mixing rate of hot water and cold water is the same for both of the water control valves 1 and 1' without the necessity to convert the existing water pipes. The simple solution offered by the present invention in case of two water control valves are mounted back-to-back in the same wall eliminates those problems found with the prior art by allowing the same regulating direction for both water control valves.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a control valve for a bathroom tap that allows back-to-back installation is essentially comprised of a body of the valve, a guide and a water temperature control unit characterized by that an adaptation trough being provided at the center of the body, a primary and a secondary supply lines connected through the adaptation trough being relatively provided on opposite sides; the guide being a hollow guide having formed at its bottom a disk-shaped adaptation part to be accommodated in the adaptation trough; a semi-circular locking groove being provided in recess on the circumference of the adaptation part; a locking screw hole in the body being provided outside the adaptation trough in relation to the where the locking groove is located; a bolt being inserted and packed into the locking screw hole; a primary and a secondary guide pipelines connecting though the primary and the secondary supply lines of the body of the valve being respectively provided on opposite sides in the guide; both of the primary and the secondary guide pipelines being also respectively connected through an upper and a lower guide channels; the water temperature control unit placed in the guide being comprised of a casing and a spindle; a leak-proof ring being provided on the casing to segregate into an upper supply area flushed onto the upper guide channel and a lower supply area flushed onto the lower guide channel; multiple water inlets being respectively provided in upper and lower supply areas; and the connection relation between the primary and the secondary guide pipelines of the guide and the primary and the secondary supply lines of the body of the valve being interchangeable.

* * * * *